US006254661B1

(12) United States Patent
Takeda et al.

(10) Patent No.: US 6,254,661 B1
(45) Date of Patent: Jul. 3, 2001

(54) METHOD AND APPARATUS FOR PRODUCTION OF METAL POWDER BY ATOMIZING

(75) Inventors: Tohru Takeda, Yamato; Yoshinari Tanaka, Hachinohe; Masami Sasaki, Hachinohe; Tokihiro Shimura, Hachinohe; Koei Nakabayashi, Hachinohe; Hiroyuki Azuma, Hachinohe; Hideo Abo, Tokyo; Toshio Takakura, Tokyo; Yoshiyuki Kato, Tokyo, all of (JP)

(73) Assignee: Pacific Metals Co., Ltd., Tokyo (JP)

( * ) Notice: Subject to any disclaimer, the term of this patent is extended or adjusted under 35 U.S.C. 154(b) by 0 days.

(21) Appl. No.: 09/284,134

(22) PCT Filed: Aug. 25, 1998

(86) PCT No.: PCT/JP98/03774

§ 371 Date: Apr. 13, 1999

§ 102(e) Date: Apr. 13, 1999

(87) PCT Pub. No.: WO99/11407

PCT Pub. Date: Mar. 11, 1999

(30) Foreign Application Priority Data

Aug. 29, 1997 (JP) ..... 9-247454

(51) Int. Cl.[7] ..... B22F 9/08

(52) U.S. Cl. ..... 75/337; 75/338; 75/339

(58) Field of Search ..... 75/337, 338, 339

(56) References Cited

U.S. PATENT DOCUMENTS

| | | | | |
|---|---|---|---|---|
| 3,592,391 | * | 7/1971 | Bender et al. | 75/338 |
| 4,382,903 | * | 5/1983 | Larsson et al. | 75/338 |
| 5,320,509 | * | 6/1994 | Oka | 75/338 |

FOREIGN PATENT DOCUMENTS

| | | | | |
|---|---|---|---|---|
| 60-155607 | * | 8/1985 | (JP) | 75/338 |
| 63-28807 | | 2/1988 | (JP) . | |
| 4-276007 | | 10/1992 | (JP) . | |
| 5-125410 | | 5/1993 | (JP) . | |

* cited by examiner

*Primary Examiner*—George Wyszomierski
(74) *Attorney, Agent, or Firm*—Wenderoth, Lind & Ponack, L.L.P.

(57) ABSTRACT

An atomizing method for producing metal powder, including splitting molten metal in the vicinity of an exit of a nozzle by introducing the molten metal into a center of the nozzle, wherein gas is flowing through the nozzle. The split molten metal is then further split into fine particles by liquid ejected in an inverse cone shaped flow from a slit surrounding a lower side of the nozzle. The resulting powder is of fine size and spherical or granular shape, and is suitable for metal injection shaping.

6 Claims, 4 Drawing Sheets

METHOD AND APPARATUS FOR PRODUCTION OF METAL POWDER BY ATOMIZING

BACKGROUND OF THE INVENTION

1. Field of the Invention

The present invention relates to a method and apparatus for production of metal powder by spraying. In particular the invention is intended to provide fine powder of spherical or granular shape suitable for metal injection shaping of sintered products.

2. Description of Related Art

Metal powder is ordinarily produced by mechanical grinding, electrolysis, chemical reduction or spraying. Among these processes, spraying is widely adopted because of capability of mass production and applicability to a variety of metals. Spraying, also called atomizing, is a method to pulverize molten metal by spraying with injection of gas or liquid into a down flow of molten metal flowing from a small hole in the bottom of a vessel like a tundish or a crucible. In this process inert gas is usually used as gas and water is usually used as liquid; the former process is called gas atomizing method and the latter process is called water atomizing method.

The gas atomizing method usually provides metal powder of spherical shape with high tapping density and low oxygen content. Therefore, this method has advantage of effectively pulverizing metals of high affinity to oxygen such as Ti and Al, or alloys containing these metals. However, this method has the disadvantage of difficulty in obtaining finer particles than the water atomizing method, especially ultra-fine particles below 10 $\mu$m, because of smaller energy of the inert gas as atomizing medium. Also, the high price of the inert gas tends to result in high costs of the powder.

On the other hand, water atomizing usually produces powder of irregular shape and low tapping density. Further, reaction between the metal and water vapor generated from the water jet leads to oxidation of the metal and increase of oxygen content in the powder. However as mentioned above, the water atomizing method enables easy production of finer powder because of its high energy of water relative to gas as atomizing medium, and has the advantage of low price of the produced powder due to use of water.

Metal powder is used for a variety of applications such as metal injection molding process (MIM), composite materials, catalysts, paints and others. The market for these applications has a strong demand for production of fine metal powder with low cost in large quantities. In particular, the market for the MIM process has a increasing demand for a low-cost supply of fine powder of spherical or granular shapes with low oxygen content, whereas the MIM process is recently drawing attention for production of metal parts of three-dimensional complex shapes. This demand includes application of water atomizing for low-cost production having a powder of metals of strong affinity to oxygen such as aforementioned Ti or Al, and also alloys of these metals.

The MIM process produces metal products through injection molding of raw material (pellets) provided with enough fluidity by mixing of binders such as wax or thermoplastic resin, followed by removal of the binders and sintering. The reason why powder of spherical or granular shape is necessary for MIM process is to give sufficient fluidity to pellets. The fluidity of pellets is considered to become higher with an increase in tapping density of metal powder, and the powder shape of high sphericity is effective to increase the tapping density (tapping density is defined in the JIS Z 2500 as "mass of powder per a unit volume in a vessel after vibration").

Moreover in the MIM process the binders should be removed easily. For good fluidity and stable shape the binders usually contain as much as 50 to 35% in volume in accordance with the amount of 50 to 65% of metal powder. As they must be removed completely in the removal process, the quantity of the binders is required to be as small as possible. Also in this instance powder of spherical or granular shape, namely high tapping density is advantageous, since the necessary amount of binders is effectively reduced and the time for binder removal is saved.

Further, fine powder is necessary for the MIM process. Generally speaking, fine powder increases the points of contact among particles and can be sintered with a higher density at a lower sintering temperature. The density of metal parts produced by MIM process is evaluated in terms of relative density. The relative density after sintering becomes higher with a decrease in the size of particles, so in general for MIM applications it is said that the average size of powder should be about 10 $\mu$m (relative density is defined in JIS Z 2500 as "ratio of density of a porous article in reference to density of an article of the same constituents free of pores").

Moreover, for the MIM process the oxygen content in metal powder is required to be low. High oxygen content leads to retention of oxygen as nonmetallic inclusion in the MIM processed metal parts and to their poor mechanical properties.

In summary, powder for the MIM process is necessary to be small in size, spherical or granular in shape, high in tapping density, and low in oxygen content. For powder of irregular shape sufficient fluidity for injection molding can be obtained by increasing the quantity of binders, however, the cost for removal of binders becomes higher and the products do not have sufficient uniformity of metallic powder leading to poor performance. In the early stage of development of MIM process, powder manufactured by carbonyl method was mainly used because of their stable supply, however, powder of carbonyl method was limited to pure metals such as iron and nickel. Recently, as MIM products are attempted to be extended to wider applications with development of the MIM technique, powder of a variety of alloys prepared by atomizing has gotten attention as the material for the MIM process. However as stated above, although the gas atomized powder products are suitable for the MIM process because of their spherical shape, high tapping density and low oxygen content, there are the drawbacks of high production cost and difficulty in obtaining fine particles.

On the other hand, although the water atomizing has the advantage of easiness in obtaining fine particles and low production cost, it has a problem in application to the MIM process due to irregular shape of the particles and low tapping density of the powder products. Use of such water atomized powder of irregular particle shape in the MIM process has the problem that injection into intricate portion is difficult. Therefore the use is limited by applicable size of metallic articles and inferiority of dimensional accuracy in the products because of the non-uniformity at the injection.

From the above-mentioned reason, a technique for low-cost mass production of metal powder for the MIM process by water atomizing is necessary, however, no satisfactory procedure is currently available. As an example of a prior art process for production of metal powder by spraying method, there is Japanese published patent No. Sho.52-19540 "Spraying and pulverizing apparatus for molten metal". It is described in the patent publication that "the present invention secures production of metal powder with suitable properties for powder metallurgy by controlling the spray form through selection of appropriate number of spray nozzles, aperture diameter of the nozzles, and surface characteristics of front edge of guide for liquid flow facing to the nozzle apertures". Therefore, the prior invention covers the same category of technique as this invention, however, it is intended for a "pulverizing apparatus to be used in mass production of powder of irregular shape suitable to powder metallurgy", as described. In this prior invention no disclosure is made of the technical aspect concerned with production of metal powder of spherical or granular shape which is the aim of this invention.

SUMMARY OF THE INVENTION

In consideration of the above mentioned current status of the art, the present invention is intended to produce fine particles by spraying at a low costs. In particular, the intention is focused on the commercial large-scale and low-cost production of fine powder of spherical or granular shape with low oxygen content which is suitable for the MIM process.

The present invention is a method for production of metal powder from molten metal, characterized in that a down flow of the molten metal is split in a vicinity of an exit of a nozzle by being introduced into a center of the nozzle wherein gas is flowing through the nozzle, and that the molten metal split is further split into fine particles by liquid ejected as an inverse cone shape flow. In the above method, preferably the gas flows into an entry of the nozzle as a laminar flow and flows out of the nozzle after a velocity of the gas becomes near or equal to the velocity of sound in the vicinity of the exit of the nozzle. It is also preferable that the pressure of the gas is decreased from the entry to the exit along the nozzle, is raised upon departure from the exit of the nozzle, and the raised pressure of the gas is decreased until reaching to a point of convergence of a liquid jet of the inverse cone shape flow.

The apparatus in accordance with the present invention for production of metal powder from molten metal is characterized by comprising a nozzle having an orifice in a center thereof, a slit surrounding a lower side of the nozzle for injection of liquid in a shape of an inverse cone, and an ejector tube which is perpendicular to lower face of the nozzle and coaxial to the orifice. The shape of the nozzle is constructed so that gas is drawn in laminar flow from an upper side of the orifice, velocity of the gas gradually increase with a decrease in area of the orifice, and the velocity of the gas reaches near or equal to the velocity of sound at an exit of the orifice. Preferably the above apparatus further comprises a baffle plate at the exit of the orifice having an aperture with a smaller diameter than an aperture of the exit of the orifice.

DETAILED DESCRIPTION OF THE INVENTION

In the process for production of metal powder from molten metal by spraying, the present invention executes successive pulverizing of molten metal by gas and then by liquid. Therefore this invention enables production of metal powder provided with combined advantages of powder property both produced by gas atomizing and by water atomizing.

Figure 1:
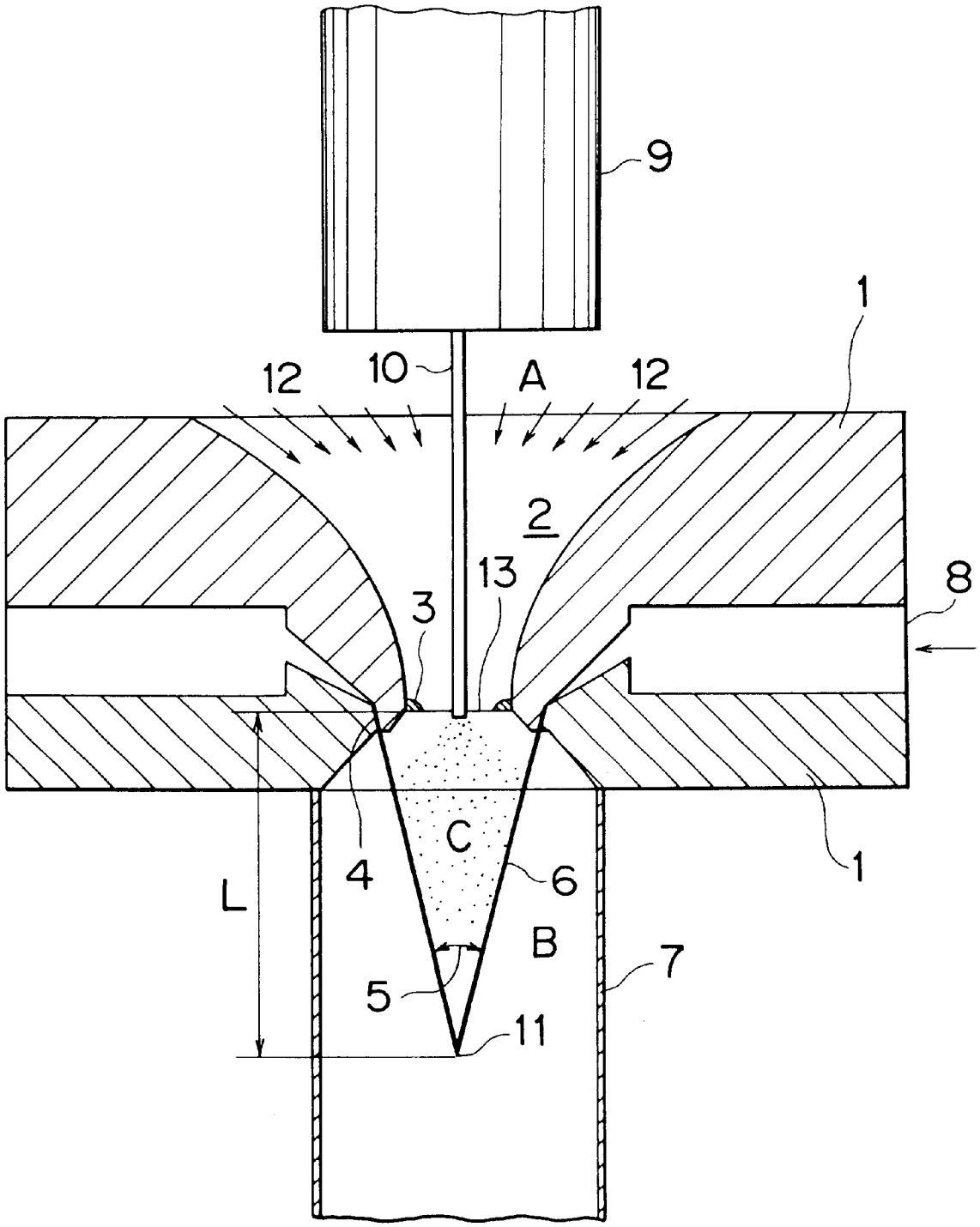
FIG. 1 is a cross-sectional view of an example of an apparatus constructed in accordance with the present invention.

The practice for carrying out the invention will be explained with reference to the attached drawings. FIG. 1 is a cross-sectional view of the apparatus exemplifying the present invention. In the FIG. 1, 1 represents a nozzle which has an orifice 2 in the thereof center. Below the nozzle 1, an ejector tube 7 is installed along the axis of the orifice 2. At the exit of the orifice 2, a baffle plate 3 is set with a smaller aperture than that of the exit of the orifice 2. At the lower side of the nozzle 1, a slit 4 is provided in order to guide liquid into the nozzle through an inlet 8 for the liquid, and a liquid jet 6 is formed by ejecting liquid from the slit 4 to be focused at the convergence point 11 of the jet.

Under formation of the liquid jet in the above configuration, molten metal is flowed down as a fine stream 10 from a vessel 9 (tundish or crucible) containing liquid metal into the orifice 2 in the nozzle 1. Then by action of gas 12 flowing into the nozzle, the molten metal is split into particles of molten metal at the region C inside of the liquid jet in the vicinity of the exit of the nozzle. The molten metal particles thus formed are further split by the liquid jet 6. Through the continuous processing of pulverization by the gas 12 and the liquid jet 6, metal powder having the advantages of being both produced by gas atomizing and by water atomizing is provided.

In the following, each condition for production of metal powder by this invention will be explained. To begin with, as a type of the nozzle 1 it is recommended to use a full-cone type nozzle. Although a variety of nozzle types has been devised, in order to perform the present invention satisfactorily, the nozzle must have a function of dividing the space into regions of B and C as shown in FIG. 1, wherein the water jet flowing from the nozzle is made wall-like by action of the inverse-cone shaped liquid jet 6.

As the nozzles suitable for the above purpose, there are a V-shape nozzle and an inverse-cone type nozzle. The inverse-cone type nozzle, also called conical-cone type or full-cone type nozzle, has a slit of continuous ring shape for liquid ejection. Therefore it produces a liquid jet of inverse-cone shape, and the pressure is negative inside the inverse-cone shape jet. Because the inverse-cone type nozzle produces a higher negative pressure than the other types of nozzles, it is most suitable for the present invention. Thus hereafter in the present description, the examples are explained by use of the inverse-cone type nozzle and the words of full-cone type nozzle represents the inverse-cone type nozzle.

Meanwhile, gas 12 is sucked into the orifice 2 together with molten metal, as liquid is introduced into the nozzle through the aperture 8 to form a liquid jet 6 converging to the focusing point 11. The gas is controlled as it flows into the orifice as a laminar flow and obtains a speed near or equal to the sound velocity at the orifice exit 13. In this way, a split of the down flow 10 of the molten metal can be achieved in the region C inside of the liquid jet 6. Here the laminar flow means the state that the gas flows at nearly the same speed as that of down flow 10 of the molten metal in the vicinity of the metal flow, and flows at a higher speed at the position apart from the down flow 10 of the molten metal. In order to maintain such a state, the orifice 2 should have a streamlined shape and also have a smooth surface for reduction of resistance to gas flow.

The above split caused by the gas is considered to be induced by an abrupt change in gas flow in the region C. The gas emerges from the orifice exit 13 at a speed as above mentioned, expands abruptly and collides against the wall of liquid jet 6, and generates expansion and compression waves by reflections of the collided gas. By repeated reflections on the wall of liquid jet 6, expansion and compression waves induce the splitting action of the down flow of molten metal as the gas atomizing phenomenon takes place.

The wall of the liquid jet 6 should be as strong as possible in order to ensure the reflection of gas in the region C inside of the liquid jet. Therefore the thickness of the liquid jet should be not less than 50 $\mu$m and the flow should be as smooth as possible. If the thickness is below 50 $\mu$m, the split of molten metal does not progress satisfactorily, because the gas breaks the liquid jet leading to a lack of expansion and compression waves. Also, if the wall is not smooth, a split of the molten metal does not occur extensively, because the directions of the reflected gas are dispersed widely and the locations of expansion and compression wave generation are dispersed.

If the speed of gas at the orifice exit 13 exceeds the sound velocity, also expansion and compression waves can be generated and have the effect of splitting of the molten metal. However, in order to maintain the velocity above the sound velocity, the negative pressure in the region C should be increased and this results in difficult operation control. Therefore, it is not necessary for the jet velocity to be higher than the sound velocity but it is sufficient to be near or equal to the sound velocity. Achievement of such a state can be detected easily by high sounds accompanying generation of the expansion and compression waves.

On the other hand, gas should flow into the orifice in a laminar flow in order to suppress disturbance in the flow of molten metal before being ejected from the orifice exit 13. If the metal flow is disturbed, the gas flow itself is disturbed leading to an unfavorable state for generation of the expansion and compression waves.

Then, for production of metal powders meeting the purpose of the present invention, the gas pressure should be controlled in the following ways.

a. Gas pressure is decreased from the entry to the exit of the nozzle.
b. Gas pressure is raised upon departure from the nozzle exit.
c. The raised pressure in the above stage b is decreased along the path down to a converging point of the liquid jet formed by ejection of liquid from the slit surrounding the lower side of the nozzle.

In more detail, the gas pressure should be controlled so as to be decreased from the upper part of orifice 2 (the position A in FIG. 1) to the orifice exit 13, then increased abruptly upon departure from the orifice exit 13, and gradually decreased as far as to the convergence point 11 of the liquid jet 6.

In the above stage a, the decrease in gas pressure from the upper part of orifice 2 (the position A in FIG. 1) to the orifice exit 13 is induced by a sucking effect caused by the liquid jet 6, which is formed by liquid flowing into the nozzle from the inlet 8 and ejecting from the slit 4. In order to achieve the purpose of the present invention, the gas pressure should be decreased as low as 510 to 30 Torr in absolute scale. When the pressure decrease is less than 510 Torr, generation of the expansion and compression waves is not satisfactory. On the other hand, a pressure decrease of more than 30 Torr is not necessary for generation of the expansion and compression waves, and moreover too much of a decrease in the pressure is a burden on production apparatus. In particular, when water is used as the liquid, controlling of water vaporization is necessary and it leads to high installation cost of apparatus. However, within the range between 510 and 30 Torr, a higher degree of the pressure decrease is recommended.

In the above stage b, the pressure rise upon emergence from the orifice exit 13 is considered to be caused by expansion and compression waves which are formed by rapid expansion of gas having a velocity near or equal to the sound velocity upon departure from the orifice exit 13, by collision against the liquid jet 6 and by reflection from the liquid jet 6. For achievement of the purpose of the present invention, the pressure rise should be not less than 50 Torr from the decreased level in the stage a.

For instance, when the pressure is decreased as low as 100 Torr in the stage a, the pressure should be raised up to 150 Torr or more in the stage b. If the pressure difference is less than 50 Torr, generation of the expansion and compression waves may be suppressed. However, the pressure increase should not exceed 560 Torr in absolute scale, because high pressure above 560 Torr leads to weak absorption of gas and adversely effects the split of molten metal.

The gas pressure increased by the above step should be decreased in a range not less than 30 Torr in absolute scale along the path to the convergent point 11 of the jet. The reason is that lowering of the pressure below 30 Torr places a burden on the apparatus as mentioned before, and particularly in use of water, it is necessary to control the amount of water vaporization. However, the pressure is favorably decreased as low as possible nearly to 30 Torr.

In order to achieve the above suitable conditions in the present invention, the pressure difference between the upper part (position A in FIG. 1) and the lower part (position B in FIG. 1) of the orifice 2 is controlled to be not less than 200 Torr. The position B in FIG. 1 is inside of the ejector tube 7 and outside of the liquid jet 6. By maintaining the pressure difference between the upper and the lower part of the orifice 2 above 200 Torr, gas (usually air, but for production of powder with a specially low oxygen content inert gas like nitrogen or argon) is accelerated in a laminar flow to reach a velocity as high as the sound velocity. Consequently at the exit 13 of the orifice 2 expansion and compression waves are generated in order to cause violent pressure changes which induce a turbulent flow. The gas, which has turned to a turbulent flow and exerted gas atomizing effect, flows by sucking effect towards the converging point 11 of the liquid jet with repeating damped vibration.

In order to satisfy the condition of pressure difference being not less than 200 Torr, a variety of factors such as size of the nozzle, an amount of the liquid, initial pressure of the liquid and size of the ejector tube should be optimized. In the case of employing the full-cone type nozzle wherein water atomizing is carried out by using air as gas and water as liquid, a diameter of the slit of the full-cone type should be in a range between 40 and 170 mm and preferably between 50 and 150 mm. An apex angle 5 of the liquid jet cone should be in a range between 10 and 80 degrees and preferably between 15 and 40 degrees, and consequently, the side area of the liquid jet cone should be not less than 0.006 $m^2$ and preferably in a range between 0.006 and 0.1 $m^2$.

By retaining the pressure difference 200 Torr or more, space for splitting of molten metal by gas is ensured.

Moreover the sucking effect of the gas by the liquid is maintained because this effect depends in proportion to side area of the liquid jet. Consequently the pressure difference promotes the split of molten metal in the vicinity of the orifice 2 and promotes further splitting of the particles of molten metal into fine particles by being taken into the liquid jet immediately.

For production of metal powder by water atomizing by using air as gas and water as liquid and using the full-cone type nozzle fulfilling the above requirements, it is necessary to control the water flow rate in a range of 300 to 1000 l/min and the water pressure to 200 kgf/cm$^2$ or more. Also the ejector tube 7 should have a diameter 1.5 times or more than the aperture of the orifice 2 and a length equal to or more than the height L of liquid jet cone.

If the water flow rate is less than 300 l/min, sufficient suction of gas cannot be obtained. On the other hand, if the water flow rate is more than 1000 l/min, further effect of pressure decrease cannot obtained. Also, as water pressure below 200 kgf/cm$^2$ does not produce sufficient suction of gas, the water pressure should be 200 kgf/cm$^2$ or more.

The reason why the ejector tube 7 has an aperture size 1.5 times or more than the aperture of orifice 2 and its height is equal or greater than the height of liquid jet cone L is for the purpose of preventing a back flow of the split molten metal toward the orifice exit 13 by maintaining necessary gas suction effect. In the present invention wherein metal powder is produced by water atomizing employing the above equipment and conditions with air as gas and water as liquid, water vapor occurring due to contact with molten metal is sucked into the liquid jet by the significantly large suction effect. Consequently oxidation of molten metal by water vapor is suppressed, then the metal powder has a low oxygen content.

Moreover, by providing a baffle plate 3 at the orifice exit 13 with a smaller aperture than that of orifice 13, the velocity of gas flow increases at the orifice exit 13. This promotes generation of the expansion and compression waves in the region C inside of the liquid jet 6, resulting in stabilization of the location where the molten metal is split by gas.

As for the down flow 10 of molten metal, the amount of flow is proportional to a square of the diameter of down flow 10 as free flow. Because the amount of flow directly influences production efficiency, a larger diameter of the down flow is recommended from the viewpoint of mass production, although the optimum diameter depends on the amount and pressure of the liquid and the orifice size.

As stated above the present invention produces, metal powder which has the combined advantages of gas atomized and liquid atomized products by successive pulverizing of molten metal by gas and then by liquid. Namely, this process can produce metal powder having fine particle size, spherical or granular shape, and a low oxygen content in a large scale and with low cost.

In this invention, as the liquid besides water, oils such as mineral oils, animal or vegetable oils, and organic liquids such as alcohol can be used. Moreover, one or combinations of additives such as carbon, alcohol and antioxidants (organic or inorganic) can be contained in water for the liquid jet.

As for the gas besides air, inert gasses such as nitrogen and argon can be used. The inert gasses are favorable in the case for production of powder of metals with a strong affinity to oxygen or powder of alloys containing such metals, and in the case where control of oxygen content in the metal powder is necessary.

In the conventional water atomizing process, water vapor occurring due to the water jet oxidizes metal particles and increases oxygen content in the powder. However, as mentioned before, in the present invention, generated water vapor is sucked into the water jet together with gas by the ejector effect, and consequently oxidation by the water vapor is minimized. Moreover, since the air can be replaced by the inert gas as above mentioned, oxygen content is reduced and therefore production of powder of metals with strong affinity to oxygen or powder of alloys containing such metals can be performed at low cost by the water atomizing method, which was formerly considered to be impossible.

Metal powder which can be produced by this invention covers stainless steels, magnetic alloys such as permendur, permalloy, sendust, alnico and silicon iron, machine structural steels, and tool steels. Furthermore production of powder is possible by Ni, Ni alloys, Co, Co alloys, Cr, Cr alloys, Mn, Mn alloys, Ti, Ti alloys, W, W alloys and others.

The present invention enables improvement in yield of fine size portion in the produced powder. Also, because of the minimization of size deviation of particles, the powder can provide direct application for the MIM process and powder metallurgy process without sieving.

In the following, the present invention will be explained in detail by examples and conventional process.

EXAMPLE 1

A full-cone nozzle was made with an aperture of the orifice of 40 mm, a diameter of the slit of 55 mm, and an apex angle of the liquid jet cone of 30 degrees. To this nozzle an ejector tube with an aperture of 90 mm and a length of 2000 mm was attached. Stainless steel SUS 316 L was atomized under an operating condition where a flow rate of the water was 390 l/min and pressure of the water was 950 kgf/cm$^2$. Molten metal was freely flowed down with a diameter of 7 mm.

Figure 2:
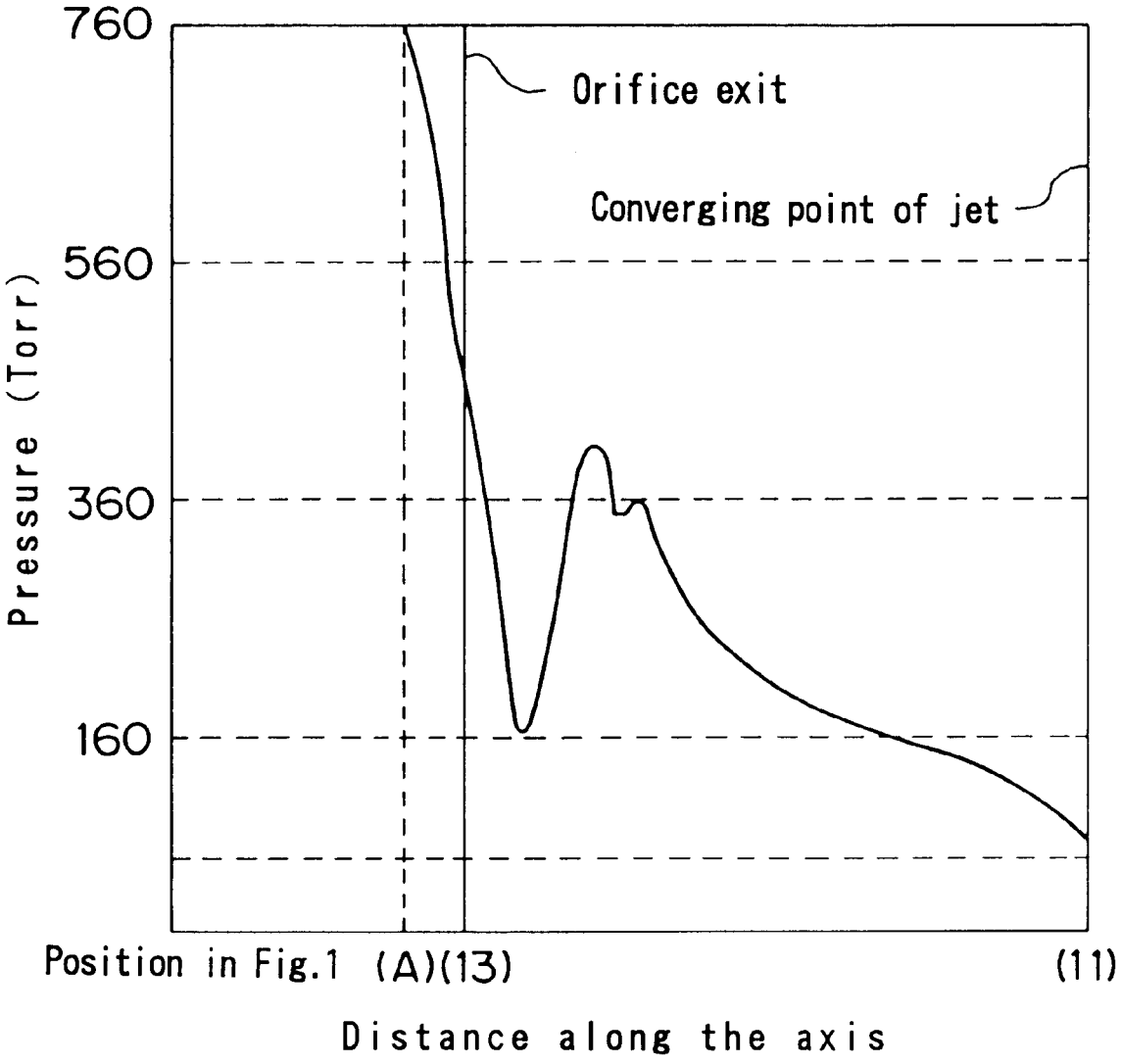
FIG. 2 is a graph representing pressure distribution in Example 1.

Under the operation in the above condition, absolute pressure at the point B in FIG. 1 was 200 Torr and pressure difference between point A and point B was 560 Torr. Pressure distribution from the point A to the converging point 11 of the water jet is shown in FIG. 2. It is shown that the pressure decreases from 760 Torr at the point A in FIG. 1 to about 460 Torr at the orifice exit, then drops abruptly down to about 160 Torr, immediately after departure from the orifice exit, then rises abruptly up to about 400 Torr, and subsequently decreases until reaching to the converging point of the jet.

Figure 3:
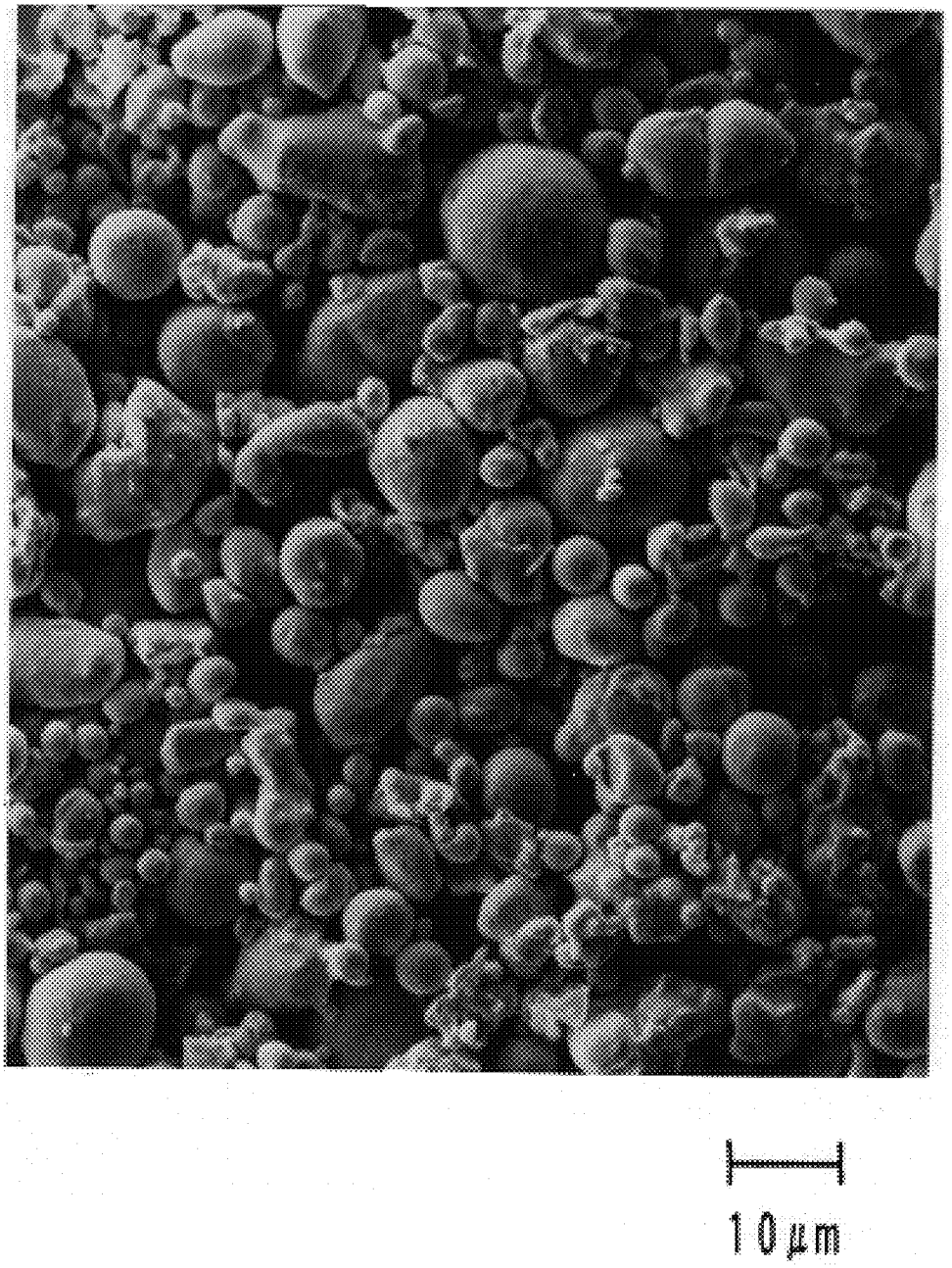
FIG. 3 is a scanning electron micrograph of metal powder produced by the process of Example 1.

The metal powder produced in this example has an average diameter of 16.7 $\mu$m. FIG. 3 shows a scanning electron micrograph of the metal powder obtained in this example. By comparing with FIG. 4, which shows the metal powder produced by a conventional. water atomizing method, a larger amount of particles of spherical shape are clearly shown in FIG. 3. The portion of metal particles not more than 10.0 $\mu$m was 32.6%, and a separation of powder satisfactory for application to the MIM process as the condition shown in Table 1, the yield of powder suitable for MIM process was 63.6%. The tapping density of the powder was 4.34 g/cm$^3$ and the oxygen content was 0.37%.

TABLE 1

Particle size condition suitable for MIM process

| Particle size distribution ($\mu$m/wt %) | | | | Average particle size |
|---|---|---|---|---|
| +30 | 30–20 | 20–10 | −10 | $\mu$m |
| <5 | <15 | remainder | >40 | 10 |

EXAMPLE 2

A full-cone nozzle was made with an aperture of the orifice of 100 mm, a diameter of the slit of 70 mm, and an apex angle of the liquid jet cone of 30 degrees. To the nozzle an ejector tube with an aperture of 125 mm and a length of 2000 mm was attached. Stainless steel SUS 316 L was atomized under an operating condition where a flow rate of the water was 750 l/min and pressure of the water was 470 kgf/cm$^2$. Molten metal was freely flowed down with a diameter of 7 mm.

In this example, in order to examine the effect of the baffle plate at the orifice exit, comparison was made for the performance with and without use of a baffle plate of 50 mm aperture.

In the case with the baffle plate, the absolute pressure at point B in FIG. 1 was 60 Torr and the pressure difference between point A and point B was 700 Torr; while without the baffle plate the absolute pressure at the point B was 130 Torr and the pressure difference between point A and point B was 630 Torr.

The metal powder produced in this example had an average diameter of 18.7 $\mu$m with use of the baffle plate and 22.0 $\mu$m without use of the baffle plate. The portion of particles not more than 10 $\mu$m was 25.0% with the baffle plate, while it was 20.4% without the baffle plate. As powder satisfying the condition shown in Table 1 is separated, its yield was 45.5% with use of the baffle plate and 34.4% without use of the baffle plate. The tapping density was 4.41 g/cm$^3$ and 4.34 g/cm$^3$ and the oxygen content was 0.35% and 0.36% with and without use of the baffle, respectively. Therefore, use of the baffle plate is shown to be advantageous.

EXAMPLE 3

Atomizing of SCM 415 steel was carried out under the same conditions as the example 1. In this instance the absolute pressure at point B in FIG. 1 was 210 Torr and the pressure difference between point A and point B was 550 Torr.

The metal powder produced in this example has average diameter of 17.6 $\mu$m. The portion of particles not more than 10 $\mu$m was 27.8%. The yield was 52.3% at separation of powder satisfying the condition shown in Table 1. The tapping density was 4.68 g/cm$^3$ and the oxygen content was 0.40%. By this example capability of atomizing of structural steels was confirmed.

EXAMPLE 4

A full-cone nozzle was made with an aperture of the orifice of 40 mm, the diameter of the slit of 100 mm, and an apex angle of the liquid jet cone of 30 degrees. An ejector tube with an aperture of 125 mm and a length of 2000 mm was attached to the nozzle. Stainless steel SUS 316 L was atomized under an operating condition where a flow rate of the water was 810 l/min and pressure of the water was 950 kgf/cm$^2$. Molten metal was freely flowed down with a diameter of 7 mm. In this instance the absolute pressure at point B in FIG. 1 was 70 Torr and the pressure difference between point A and point B was 690 Torr.

The metal powder produced in this example has average diameter of 11.0 $\mu$m. The portion of particles not more than 10 $\mu$m was 44.6%. The yield was 100.0% at separation of powder satisfying the condition shown in Table 1. The tapping density was 4.30 g/cm$^3$ and the oxygen content was 0.33%.

Comparison with the Conventional Method

A pencil type nozzle was used wherein 24 nozzles were arranged around the axis of fine down flow of the molten metal, and pencil jets from the nozzles were converged toward a point on the axis. Atomizing of stainless steel SUS 316 L was performed under a flow rate of the water 750 l/min and pressure of the water 470 kgf/cm$^2$ which were same as Example 2. Molten metal was freely flowed down with a diameter of 7 mm.

Figure 4:
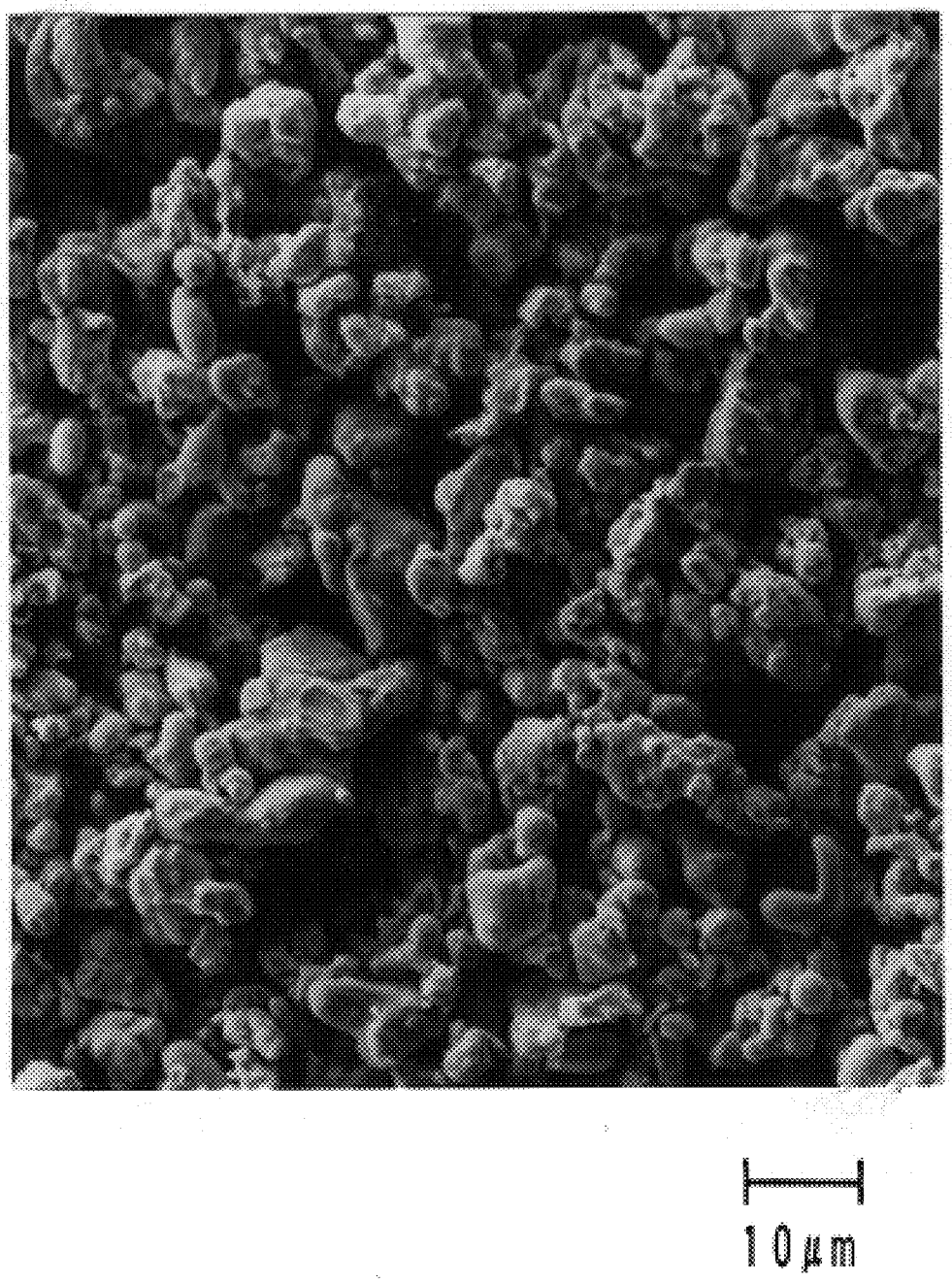
FIG. 4 is a scanning electron micrograph of metal powder produced by a conventional method.

The metal powder produced in this comparison method has average diameter of 29.9 $\mu$m. The portion of particles not more 10 $\mu$m was 10.0%. The yield was 16.4% at separation of powder satisfying the condition shown in Table 1. The tapping density was 3.76 g/cm$^3$ and the oxygen content was 0.45%. This result shows lower yield, lower tapping density and higher content of oxygen than the result of Example 2. Furthermore as mentioned before, it is obvious that particles of irregular shape prevail as shown in FIG. 4 of the scanning electron micrograph.

Application to Industries

The present invention provides means for production of metal powder with combined advantages of both gas atomizing and liquid atomizing products in a large amount and at low cost. The invention improves accuracy in size of the articles made from metal powder, enhances productivity on a large scale, and contributes to cost reduction. Since the powder with a low oxygen content is available, mechanical and magnetic properties of products are improved. Metal or alloy products which could not be made from powder due to lack of suitable powder as raw materials, can be manufactured from powder in competing with bulk method products. Thus, the present invention is effective in expansion of the use and demand of metal powder and contributes to innovation of production methods, reduction of cost, and to development of new applications in powder metallurgy industry.

What is claimed is:

1. A method of producing metal powder by atomizing molten metal, the method comprising:

supplying a flow of molten metal down through a center of an orifice defined by a nozzle, wherein the nozzle includes a continuous ring-shaped slit located below the orifice;

spouting a jet of liquid, having a shape of an inverse cone, from the slit and into an ejector tube disposed below the slit;

sucking gas through the orifice of the nozzle, wherein the surface of the nozzle forming the orifice has a streamlined shape and is located above the slit;

splitting the molten metal by an abrupt expansion of the gas in the vicinity of an exit of the orifice; and further splitting the split molten metal into fine particles by the jet of liquid, wherein the slit has a diameter of 50 to 150 mm, the inverse cone of the liquid jet has an apex angle of 10 to 80 degrees, the ejector tube has a diameter that is not less than 1.5 times the diameter of the exit of the orifice, the ejector tube has a length that is not less than a height of the liquid jet cone, the liquid is spouted at a flow rate of 300 to 1000 l/min, a pressure of the liquid is not less than 200 kgf/cm$^2$, and a diameter of the orifice at the exit is sized so that the gas flows out of the orifice near or equal to the velocity of sound.

2. The method as claimed in claim 1, further comprising increasing the velocity of the gas flowing out from the orifice by providing a baffle plate at the exit of the orifice, wherein the baffle plate includes an aperture having a smaller diameter than the diameter of the orifice at the exit.

3. The method as claimed in claim 2, wherein the pressure of the gas decreases along the orifice from the entry of the orifice to the exit of the orifice, the pressure of the gas rises upon exiting from the exit of the orifice, and the raised pressure of the gas then decreases until the gas reaches a point of convergence of the liquid jet having the inverse cone shaped flow.

4. The method as claimed in claim 3, wherein the pressure decrease of the gas from the entry of the orifice to the exit of the orifice is at least 200 Torr.

5. The method as claimed in claim 1, wherein the pressure of the gas decreases along the orifice from the entry of the orifice to the exit of the orifice, the pressure of the gas rises upon exiting from the exit of the orifice, and the raised pressure of the gas then decreases until the gas reaches a point of convergence of the liquid jet having the inverse cone shaped flow.

6. The method as claimed in claim 5, wherein the pressure decrease of the gas from the entry of the orifice to the exit of the orifice is at least 200 Torr.

* * * * *